US006575727B2

(12) United States Patent
Ciccarello et al.

(10) Patent No.: US 6,575,727 B2
(45) Date of Patent: Jun. 10, 2003

(54) APPARATUS FOR ROUGHING SURFACES OF CONCRETE CASTED BLOCKS

(75) Inventors: Charles Ciccarello, Brossard (CA); Yvon Laporte, St-Nobert-Berthier (CA); Hugo Laporte, St-Norbert-Berthier (CA)

(73) Assignee: Techo-Bloc, Inc., St. Hubert (CA)

( * ) Notice: Subject to any disclaimer, the term of this patent is extended or adjusted under 35 U.S.C. 154(b) by 85 days.

(21) Appl. No.: 09/911,121

(22) Filed: Jul. 24, 2001

(65) Prior Publication Data

US 2002/0158363 A1 Oct. 31, 2002

(30) Foreign Application Priority Data

Apr. 26, 2001 (CA) ..... 2345224
May 28, 2001 (CA) ..... 2349095

(51) Int. Cl.[7] ..... B28B 11/08
(52) U.S. Cl. ..... 425/343; 425/385; 264/293
(58) Field of Search ..... 425/343, 385, 425/402, 403.1, 472; 249/67, 68; 264/293

(56) References Cited

U.S. PATENT DOCUMENTS 1,229,582 A * 6/1917 Butterworth ..... 264/145
1,672,938 A * 6/1928 Hervey ..... 264/162
2,146,957 A 2/1939 Barker Jones
3,754,850 A * 8/1973 Pate ..... 425/385
4,108,586 A * 8/1978 Gresham, Jr. ..... 425/385
4,147,491 A * 4/1979 Postell, Jr. ..... 425/385
4,568,260 A * 2/1986 Paul et al. ..... 425/106
5,133,915 A 7/1992 Metten et al. ..... 264/293
6,109,906 A * 8/2000 Castonguay et al. ..... 425/343

FOREIGN PATENT DOCUMENTS

| | | | |
|---|---|---|---|
| CA | 2 127 191 A | | 10/1994 |
| DE | 39 27 601 A | | 3/1991 |
| DE | 41 42 396 | * | 6/1993 |
| DE | 195 48 932 | * | 7/1997 |
| DE | 198 45 174 A | | 4/2000 |
| EP | 0 904 906 A | | 3/1999 |

* cited by examiner

*Primary Examiner*—W. L. Walker
*Assistant Examiner*—Thu Khanh T. Nguyen
(74) *Attorney, Agent, or Firm*—Ogilvy Renault; Guy J. Houle

(57) ABSTRACT

An apparatus and method for roughing surfaces and edges of concrete casted blocks, comprising a block support surface having a plurality of surface sections. A first of the surface sections has a rear end thereof above an adjacent front end of a second of the surface sections to create a ledge for projecting a leading edge portion of concrete blocks conveyed over the first surface section. A first roughing device has a plurality of impacting elements thereon for roughing concrete blocks. The first roughing device is disposed generally above the rear end of the first surface section for abrading a projecting leading edge portion of each concrete block as they are conveyed over the rear end. A conveyor displaces concrete blocks over the first and second surface sections, the blocks being tilted when reaching a predetermined position over the ledge to avoid being abraded by the roughing device.

19 Claims, 4 Drawing Sheets

APPARATUS FOR ROUGHING SURFACES OF CONCRETE CASTED BLOCKS

FIELD OF THE INVENTION

The present invention relates to casted concrete block manufacturing and, more particularly, to an apparatus and method for roughing blocks to give them a worn or rough appearance.

BACKGROUND OF THE INVENTION

The concrete block casting industry is well developed and is highly automated in its process operations for manufacturing conventional rectangular concrete blocks and the like. The casted blocks have a geometrically uniform rectangular prism configuration in which the surfaces thereof are substantially planar with adjacent surfaces delimited by sharp edges.

It has been known to treat the concrete blocks in order to get a more natural rough look. As authentic stone blocks are known to have rounded edges and irregular shaped surfaces, systems have been provided in order to produce such effect on casted concrete blocks. However, the equipment used in order to treat these blocks has been incompatible with the fully automated handling equipment used in the other operations of the concrete block producing process. Substantial amount of manual labor and high costs are inherent with the presently used block roughing systems.

For instance, a known method consists in disposing the casted blocks in large tumbling drums. These tumbling drums are rotated about their longitudinal axis in order for the concrete blocks to tumble therein and to collide in order to get damaged. This method, although producing a generally satisfying look, entails substantial costs due to unrepairable damages to concrete blocks. Some blocks are damaged to a point where they may no longer be used and are thus thrown away or recycled. Also, some concrete block patterns may contain blocks of different sizes and these must be sorted and assembled, which is very time consuming. Also, if a particular one of the blocks in pattern is destroyed more than other blocks, then often the other blocks are no longer useful as a ratio of blocks must be kept. By its nature, the tumbling drum requires frequent repairs. Furthermore, the personnel used for these purposes must deal with a noisy environment due to the tumbling action, and injuries are frequent due to the hazardous operations and handling required thereby. It is difficult to maintain a stable labour force for this work.

U.S. Pat. No. 5,133,915, issued on Jul. 28, 1992 to Metten et al., discloses a surface upon which a plurality of concrete blocks are disposed in a spaced apart relationship. A roller brush translates over the surface of concrete blocks in a reciprocating manner, thereby stripping and roughing the surface of the concrete blocks. Although this method provides substantial advantages over the tumbling drum method described above, it requires that the concrete blocks are spaced apart in order for the sharp edges thereof to be treated. Otherwise, only the top surface would be abraded. Furthermore, the brush type roller provides a relatively uniform abrasion of the concrete blocks, which is not a desired result for use with paving blocks. Finally, as the concrete blocks are spaced apart, the brush can only strike them at a certain velocity in order not to displace them. If they are displaced, they may end up in abutment with one another, whereby only the top surfaces will be abraded, leaving the sharp edges of the block intact. These blocks are usually treated before the concrete is cured. This patent could not provide the desired result of producing an irregular roughened appearance to concrete blocks.

SUMMARY OF THE INVENTION

It is a feature of the present invention to provide a concrete block roughing apparatus and method which substantially overcomes the disadvantages of the above mentioned prior art.

According to the above features, from a broad aspect, the present invention provides an apparatus for roughing at least one of surfaces and edges of solid concrete casted blocks, comprising a block support surface having at least two surface sections. The surface sections have straight front and rear end edges disposed parallel to one another. A first of the surface sections has at least its rear end edges thereof above an adjacent front end edge of a second of the surface sections to create a ledge for projecting a leading edge portion of concrete blocks conveyed over the first surface section. A roughing device is supported a predetermined distance above the block support surface and has a plurality of impacting elements thereon for roughing concrete blocks in a non-uniform fashion. The first roughing device is disposed generally above the rear end edge of the first surface section for abrading a projecting leading edge portion of each concrete block as they are conveyed over the rear end edge. Conveying means displace the concrete blocks over the first and second surface sections, the blocks being tilted when reaching a predetermined position over the ledge to avoid being abraded by the roughing device.

According to a further broad aspect of the present invention, there is provided a method for roughing portions of concrete casted blocks comprising the steps of (i) providing a block support surface having at least a section thereof inclined to create a ledge for projecting a leading edge portion of concrete blocks conveyed over the ledge by conveying means; (ii) providing at least a roughing device having a plurality of impacting elements thereon and disposed at a predetermined position above the ledge; and (iii) impacting the leading edge portions of the concrete blocks by the roughing device as they are projected over the ledge by the conveying means, the blocks being tilted when reaching a predetermined position over the ledge to avoid being abraded by the roughing device.

BRIEF DESCRIPTION OF THE DRAWINGS

A preferred embodiment of the present invention as illustrated by examples thereof will now be described with reference to the accompanying drawings in which.

DESCRIPTION OF PREFERRED EMBODIMENTS

Figure 1:
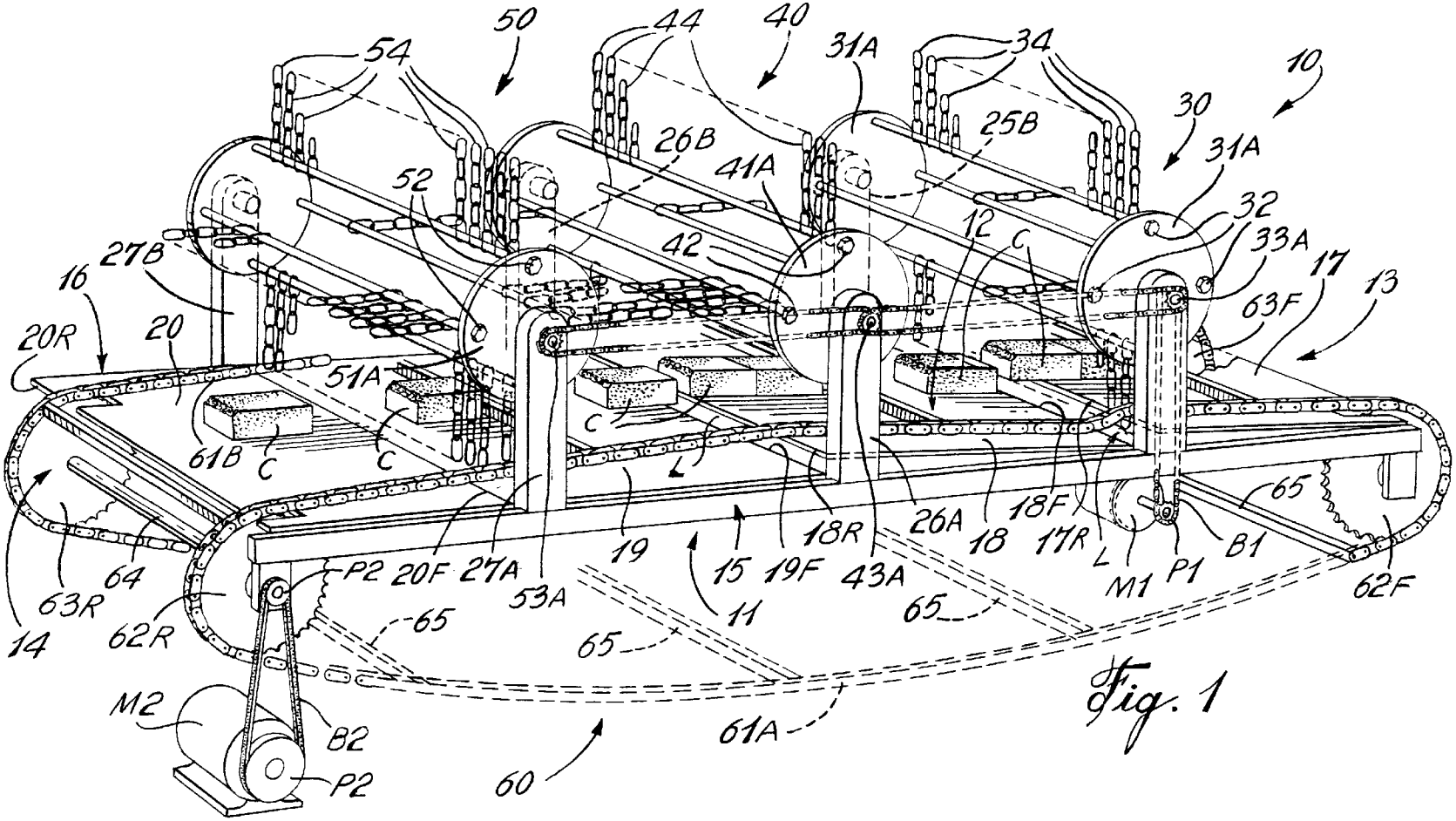
FIG. 1 is a perspective view of an apparatus for roughing concrete blocks in accordance with the present invention.

According to the drawings and, more particularly to FIG. 1, an apparatus for roughing concrete blocks (i.e bricks, paving stones, wall retaining blocks, masonry stones) is generally shown at 10. The apparatus 10 comprises a table 11 having a top surface 12, a front end 13, a rear end 14 and lateral sides 15 and 16. The top surface 12 is defined by rectangular panels 17, 18, 19 and 20. It is observed that the rectangular panel 17 is at the front end 13 of the table 11, whereas the rectangular panel 20 is at the rear end 14 thereof.

The rectangular panels 17, 18 and 19 are each secured to the table 11 in a slanted or inclined position with respect to the horizontal, such that each of the rectangular panels 17 and 18 has its front side edge lower than its rear side edge. Rectangular panel 19 is flat on the table for reasons which will be described later. Consequently, as seen in FIG. 1, a rear side edge 17R of the rectangular panel 17 is vertically offset with respect to adjacent front side edge 18F of the rectangular panel 18, such as to be above it to create a space L. It is pointed out that there is a similar relation between the front side and rear side edges of the rectangular panels 18 and 19. It is also pointed out that the rectangular panel 20 is substantially horizontal and in a co-planar relationship with the rectangular panel 19. Its rear side edge 20R represents the rear end 14 of the table 11. Also, the present invention is not restricted to four rectangular panels as fewer or more rectangular panels could form the table 11. Furthermore, the successive rectangular panels being cascaded could each have been in a horizontal position rather than in a slanted position, with a decrease in vertical positioning from the front end 14 of the table 11 to the rear end 15 thereof, such as to, again, have a cascading relation between the rectangular panels.

Support posts 25A and 25B project upwardly from the lateral sides 15 and 16, respectively, of the table 11 on opposed sides of the junction of the rectangular panels 17 and 18. Similar support posts 26A and 26B, and 27A and 27B are upwardly extending at opposed sides of the junctions of the rectangular panels 18 and 19, and of the rectangular panels 19 and 20, respectively.

Each of the support posts has at a top end thereof a throughbore having a journal bearing therein (not shown). The support posts 25A and 25B support a roughing tool 30 through their journal bearings. The roughing tool 30 is comprised of a pair of disks 31A and 31B removably linked by support bars 32. A drive shaft 33A is secured to the disk 31A, whereas the other disk 31B is connected to an idle and free to rotate shaft (not shown) journaled at the top end of the support post 25A. A plurality of chain link sections 34 are secured to the support bars 32, and are comprised of at least two interconnected loop chain links. The support bars 32 extend through an end loop of each chain link section 34. By rotating the roughing tool 30 on its longitudinal axis, the chain link sections 34 will impact predetermined areas of concrete blocks C disposed on the table 11, as will be described later. The roughing tool 30 is rotated by a motor M1 connected to the drive shaft 33A by a belt B1 and pulley P1 assembly. The motor M1 may consist a variable speed electric motor.

Generally identical roughing tools 40 and 50 are journaled between the support posts 26A and 26B, and 27A and 27B, respectively. The roughing tools 40 and 50 comprise the same elements as the roughing tool 30. Therefore, the roughing tools 40 and 50 will not be described. However, when referring to FIG. 1, like elements will be related by having like last digits. For instance, the disks 31A and 31B for the roughing tool 30 are generally identical to the disks 41A and 41B of the roughing tool 40. Similarly, the disks 51A and 51B of the roughing tool 50 are generally identical to the disks 31A of the 31B of the roughing tool 30. However, for clarity purposes, the motors and belt/pulley assemblies driving the roughing tools 40 and 50 are not shown.

Figure 2:
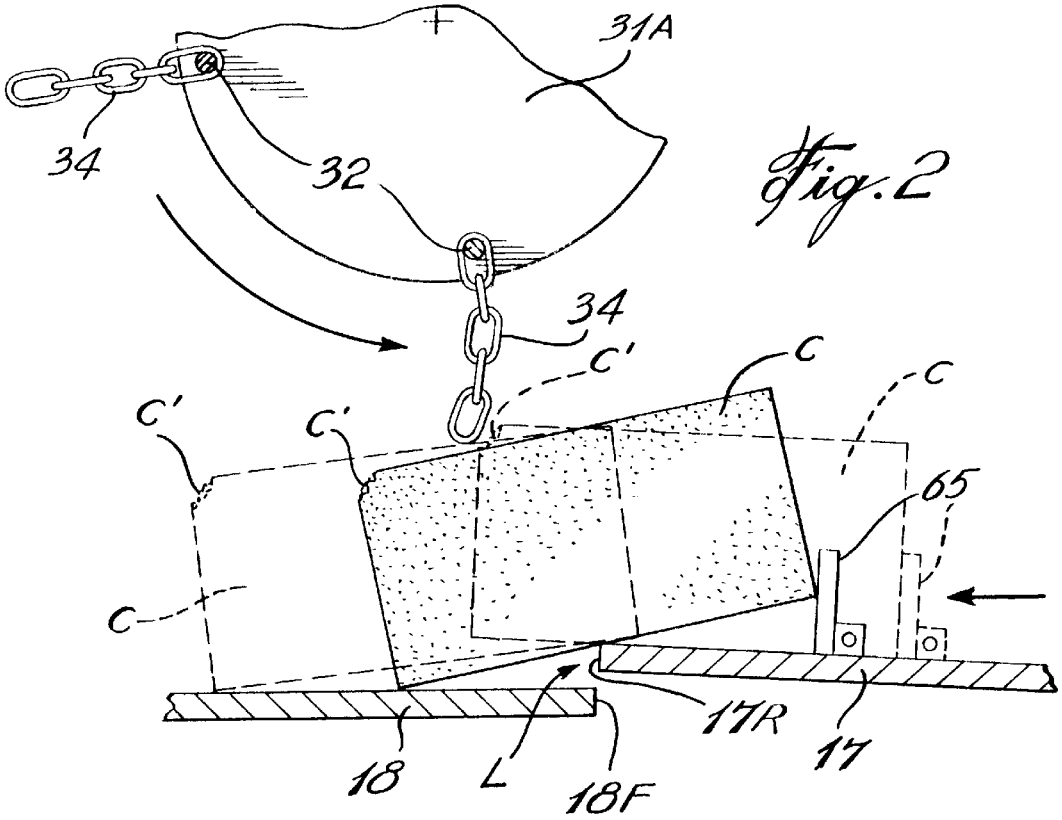
FIG. 2 is an enlarged elevational view of slanted support panels and a roughing tool in accordance with the present invention.

The slanted or inclined positioning of the rectangular panels 17 and 18, whereby they are cascaded, allows for given portions of the concrete blocks C disposed on the top surface 12 of the table 11 to be exposed to the chain link sections 34 and 44 of the roughing tools 30 and 40, respectively, during their travel over the panels and specifically over the ledges. As best seen in FIG. 2, the configuration of the rectangular panel 17 with respect to panel 18 allows for only an edge C' of a concrete block C to be exposed for being impacted by the chain link sections 34 as it is conveyed by the conveyor bars 65 over the ledge L. As a bottom face of the concrete block C is projected over the ledge L, the block C will tilt down and fall on the rectangular panel 18, and its top surface C" will avoid the chain link sections 34. As the concrete block C further advances on the table 11, contact with the chain link sections 34 is still avoided until it is projected again on the next ledge. The roughing tools 30, 40 and 50 may be positioned strategically with respect to the table 11 in order for predetermined portions of the concrete blocks C to be abraded.

Consequently, the slanted configuration of the rectangular panels 17 and 18 allows for only the exposed edge portions of the concrete blocks C to be roughened. In the embodiment shown, three roughing tools are provided in order to treat the concrete blocks C disposed thereon for various effects. The roughing tool 30 is positioned to strike the exposed edges C' of the concrete blocks C such as to do a rough treating thereof and remove bigger chunks of material. The roughing tool 40 is positioned such as to treat the edges of the blocks C to a smoother finishing. As can be seen, rectangular panel 19 is flat and the roughing tool 50 is positioned to abrade the top surface C" of the blocks C.

Figure 3:
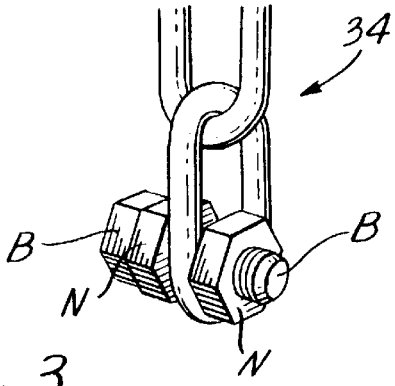
FIG. 3 is an enlarged perspective view of an embodiment of the roughing tool.

The roughing tools 30, 40 and 50 are driven by a variable speed motor (not shown) and may thus be rotated to various speeds in order to impact the concrete blocks C at various forces. They can also be independently driven. As seen in FIG. 3, a bolt B and nuts N have been added to an end chain link of a chain link section 34 such as to provide a random pattern on the concrete blocks C upon same being struck.

Returning now to FIG. 1, the apparatus 10 is provided with a conveyor 60 to displace the concrete blocks C over the panels 17, 18, 19 and 20. The conveyor 60 comprises a pair of chain loops 61A and 61B adjacent the lateral sides 15 and 16, respectively, of the table 11. The chain loop 61A is operatingly held about a pair of sprockets 62F and 62R, with the sprocket 62R being driven by a motor M2 and a belt B2 and pulley P2 assembly. The chain loop 61B is disposed about a sprocket 63F and the driven sprocket 63R, the latter being connected to an opposed end of an axle 64 upon which is secured the sprocket 62R. The chain loops 61A and 61B are linked by a plurality of bars 65 which are equidistantly spaced. The bars 65 come in contact with the concrete blocks C disposed on the top surface 12 of the table 11 such as to displace the concrete blocks C from the front end 13 to the rear end 14 thereof. It is noted that the motor M2 may be of various speeds in order to provide various velocities to the blocks moving forward.

Figure 4:
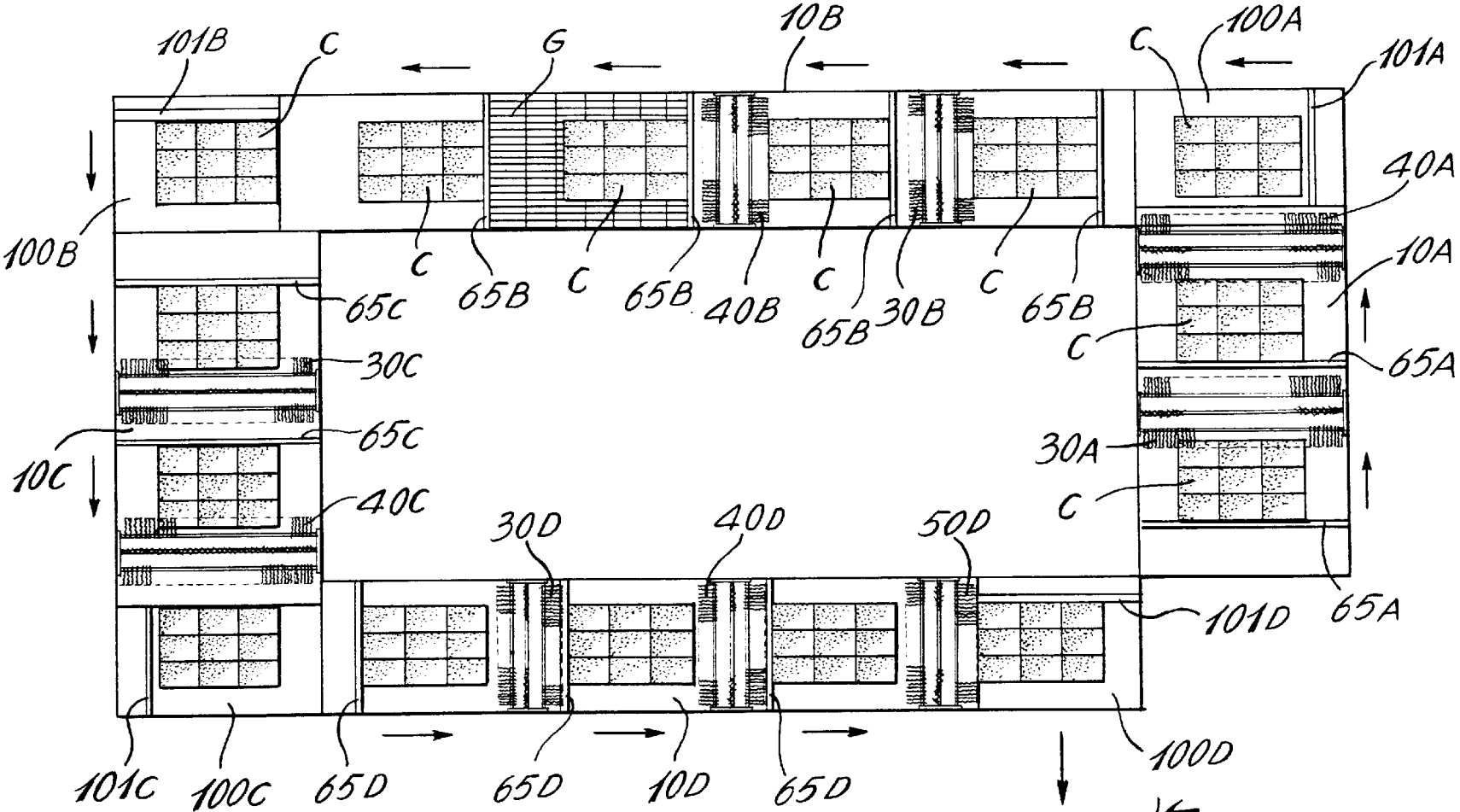
FIG. 4 is a simplified schematic top plan view of a series of apparatuses for roughing concrete blocks.

As shown in the schematic representation of FIG. 4, a plurality of apparatuses for roughing concrete blocks or tables in accordance with the present invention may be provided in series in order to treat the various edge surfaces and top surfaces of the concrete blocks C. Concrete blocks C are initially loaded onto apparatus 10A such as to have first lateral side edges thereof treated by roughing tools 30A (rougher edge finish) and 40A (smoother edge finish). For clarity purposes, elements of an apparatus have been affixed a like letter (for instance, roughing tool 30A of apparatus 10A). The concrete blocks C are then transferred to a transfer table 100A, where a push bar 101A will load the concrete blocks C to apparatus 10B. It is pointed out that the front side edges of the concrete blocks C will now be treated as a consequence of the apparatus 10B being perpendicular to the apparatus 10A.

The concrete blocks C will then move onward to the apparatuses 10C and 10D through the transfer tables 100B and 100C, respectively, so as to be treated on all side edges. A third roughing tool 50D is provided on the apparatus 10D to treat the top surface of the concrete blocks C. This operation only requires to be achieved once as all side edges of the concrete blocks C share the same top surface. The concrete blocks can be loaded on to a stack of concrete blocks (not shown) by transfer table 100D at an end of the series of apparatuses. It is observed that a plurality of concrete blocks C are treated at a same time on the series of apparatuses, whereby this configuration advantageously allows for a continuous output of treated concrete blocks.

The panels forming the block support surface of the apparatuses may be solid. It has also been thought to provide a grid surface, as shown at G for one of the panels of apparatus 10B in FIG. 4, so that concrete particles resulting from the concrete blocks being treated fall through the grid surface G to the floor, thereby not accumulating on the top surface of the panels.

Figure 5:
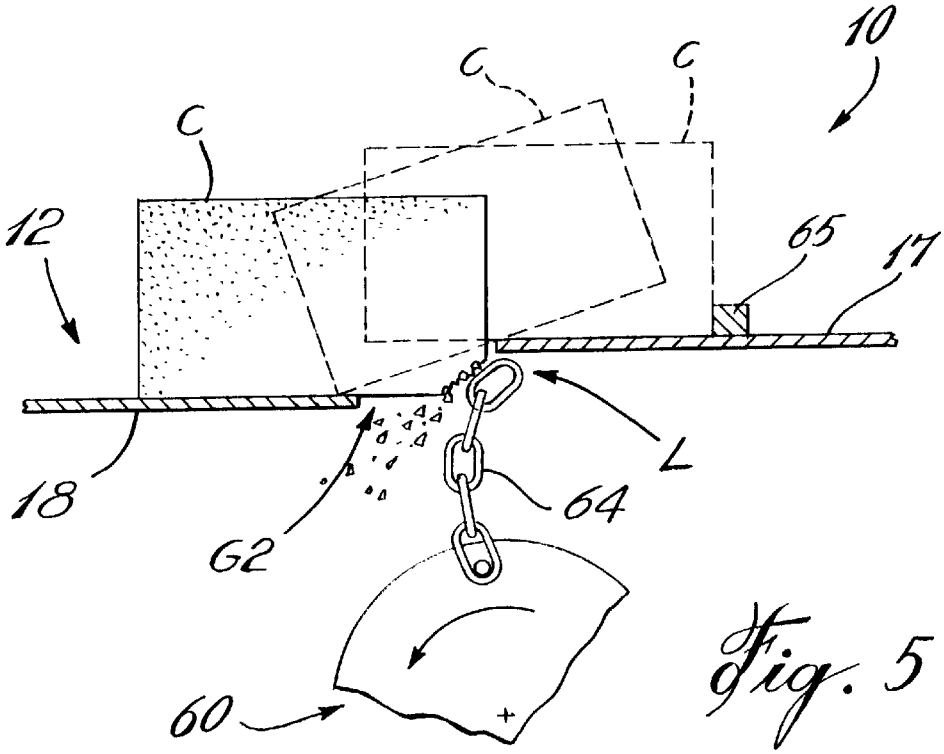
FIG. 5 is an enlarged side elevational view of another embodiment of the apparatus for roughing concrete blocks of the present invention.

Referring to FIG. 5, a further embodiment of the apparatus 10 is shown, wherein the concrete blocks C will be abraded from a roughing tool 60, similar to the roughing tools 30, 40 and 50 described above, but disposed underneath the top surface 12, herein shown below rectangular panels 17 and 18. The rectangular panels 17 and 18 in this embodiment are shown further spread apart by a gap G2, as well as being offset by space L, to allow for the bottom trailing edges of concrete blocks C to drop in the gap G2 to be exposed to the abrading chain link sections 64 of the roughing tool 60 to be abraded thereby. Guides (not shown) are provided such that the bars 65 and the chain loops 61A and 61B avoid the chain link sections 64 of the roughing tool 60 when moving across the gap G2.

Figure 6:
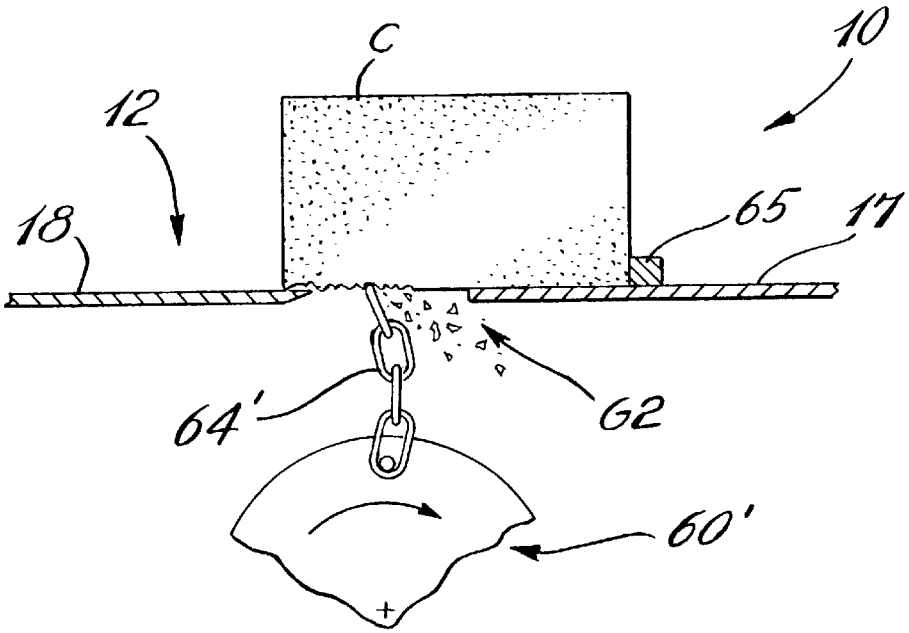
FIG. 6 is an enlarged side elevational view of still another embodiment of the apparatus for roughing concrete blocks of the present invention.

Referring to FIG. 6, the roughing tool 60 is depicted once more underneath the top surface 12 of the roughing apparatus 10, yet the rectangular panels 17 and 18 are not offset by the space L, whereby the concrete blocks driven across the gap G will have their bottom trailing surfaces exposed to be abraded by the chain link sections 64' of the roughing tool 60'.

Having the roughing tool 60 below the top surface 12 ensures that the chips or the dust resulting from the abrading action on the concrete blocks C will not accumulate on the top surface 12 of the apparatus 10. The roughing tool below the top surface 12 are used in combination with roughing tools disposed above the top surface 12 of the apparatus 10, as described above, whereby two opposed sides and edges of the concrete blocks C are abraded on the same apparatus.

It is within the ambit of the present invention to cover any obvious modifications of the embodiments described herein, provided such modifications fall within the scope of the appended claims.

We claim:

1. An apparatus for roughing at least one of surfaces and edges of solid concrete casted blocks, comprising:

a block support surface having at least two surface sections extending across the width of a travel path of a plurality of said blocks being conveyed over said surface sections, said surface sections having a straight front edge and a rear end edge disposed parallel to one another, a first of said surface sections having said read end edge thereof disposed above an adjacent front end edge of a second of said surface sections to create a space for projecting a leading edge portion of concrete blocks conveyed over said first surface section down to said second surface section;

a roughing device disposed a predetermined distance above said block support surface and having a plurality of impacting elements thereon for roughing concrete casted blocks in a non-uniform fashion, said first roughing device being disposed generally above said rear end edge of said first surface section for abrading a projecting leading transverse edge portion of each said concrete casted block as they are conveyed over said rear end edge; and conveying means for displacing concrete blocks over said first and second surface sections, said casted blocks being titled when reaching a predetermined position over said space to fall on a second of said two surface sections at said straight front edge thereof.

2. The apparatus according to claim 1, wherein said surface sections are also separated by a gap, said apparatus having at least a further roughing device having a plurality of elements thereon for roughing concrete blocks, said further roughing device being disposed generally below said rear end edge of said first surface section for abrading a trailing end portion of each said concrete block falling in said gap upon leaving said first surface section.

3. The apparatus according to claim 2, wherein said apparatus comprises further surface sections, said further surface sections being generally coplanar and separated by a further gap, said apparatus having at least a still further roughing device with a plurality of elements thereon for roughing concrete blocks, said still further roughing device being disposed generally below said further gap between said surface sections for abrading a bottom surface of each said concrete block being displaced over said gap.

4. The apparatus according to claim 1, wherein said surface sections are inclined such that said rear end edge of said first surface section is above said front end edge of said subsequent second surface section.

5. The apparatus according to claim 4, wherein said block support surface is constituted of inclined solid panels, whereby said surface sections are top surfaces of said inclined panels.

6. The apparatus according to claim 4, wherein each said surface section is constituted of an inclined grid panel, so that concrete particles fall therethrough.

7. The apparatus according to claim 1, wherein said conveying means is in abutment engagement with said concrete blocks to slide said concrete blocks over said block support surface from said front end edge to said rear end edge thereof.

8. The apparatus according to claim 1, wherein said roughing device is an elongated impact rotor, said rotor being supported horizontally and having a drive shaft at one end thereof, a motor being connected to said drive shaft to impart axial rotation to said rotor about a central longitudinal axis thereof, and said plurality of impacting elements being secured along a working section of said rotor, said impacting elements being flexible and constructed of material having a hardness greater than hardness of said concrete blocks, said impacting elements being dimensioned to abrade or chip said concrete blocks when impacted thereon by rotation of said drive shaft.

9. The apparatus according to claim 8, wherein said motor is a variable speed electric motor.

10. The apparatus according to claim 8, wherein said impacting elements of said roughing device are chain link sections.

11. The apparatus according to claim 10, wherein said chain link sections are secured to one or more support bars connected between a pair of bar attachment disks, said drive shaft being secured to one of said disks, the other of said disks having an idle shaft connected thereto.

12. The apparatus according to claim 11, wherein said chain link sections have at least two interconnected loop chain links, each said support bars extending through an end loop of a plurality of chain link sections, said support bars being removably connected to said bar attachment disks.

13. The apparatus according to claim 12, wherein at least one free end loop of said plurality of chain link sections has an impacting device secured thereto.

14. The apparatus according to claim 13, wherein said impacting device is a bolt and nut assembly.

15. The apparatus according to claim 7, wherein said conveying means has a pair of motor driven chains interconnected by a plurality of spaced push bars, said chains being disposed on opposed sides of said table such that said push bars push the concrete blocks from a front end of said table to a rear end thereof.

16. The apparatus according to claim 15, wherein said chains are trained about driven and idle sprockets which are motor driven by a variable speed motor.

17. A concrete casted blocks roughing line comprising at least two apparatuses according to claim 1, a first one of said apparatuses being placed upstream of at least a second one of said apparatuses, whereby concrete blocks transferred from said first one of said apparatuses to said second one of said apparatuses are positioned so as to have side edges unabraded on said first one of said apparatuses abraded on said second one of said apparatuses.

18. The concrete casted blocks roughing line according to claim 17, wherein subsequent apparatuses are in a generally perpendicular relation with respect to one another so as to have unabraded side edges abraded on a downstream one of said subsequent apparatuses.

19. The apparatus according to claim 1, wherein said conveying means is a pushing conveying means for pushing a plurality of casted blocks with the blocks disposed side-by-side in at least two rows of blocks in contact with one another; said casted blocks of a first of said at least two rows, when falling on said second surface section, exposing said projecting leading transverse edge portion of trailing concrete casted blocks of a second of said at least two rows for being abraded by said roughing device as it is being projected over said rear end edge.

* * * * *